33-241
1/29/85 XR 4,495,705

United States Patent [19]
Kowalski et al.

[11] Patent Number: 4,495,705
[45] Date of Patent: Jan. 29, 1985

[54] ILLUMINATED SIGHT FOR AIMING A BOW

[76] Inventors: Robert J. Kowalski, 540 Old Plank Rd., Rte. 8, Butler, Pa. 16001; William C. Wilmoth, 233 Cameron Dr., Mars, Pa. 16046

[21] Appl. No.: 495,137

[22] Filed: May 16, 1983

[51] Int. Cl.[3] ..... F41G 1/46; F41G 1/34
[52] U.S. Cl. ..... 33/265; 33/241; 124/87
[58] Field of Search ..... 33/265, 241; 124/87

[56] References Cited

U.S. PATENT DOCUMENTS 3,450,122 6/1969 Diamond ..... 33/265
3,945,127 3/1976 Spencer ..... 33/265
4,166,324 9/1979 Carollo et al. ..... 33/265
4,170,071 10/1979 Mann et al. ..... 33/265
4,177,572 12/1979 Hindes ..... 33/241
4,220,983 9/1980 Schroeder ..... 33/241

*Primary Examiner*—Willis Little

[57] ABSTRACT

A sight for aiming a bow includes a sight assembly affixed to the bow and supporting a sight pin assembly that is illuminated. The sight pin assembly includes first and second members that are joined together by a releasable connection and one of the members supports an incandescent light bulb. The other member is transmissive to light rays and delivers the light to a tip portion there it is dispersed therefrom. The light bulb is connected by lead wires in an electrical circuit that includes a battery and a switch.

9 Claims, 9 Drawing Figures

ILLUMINATED SIGHT FOR AIMING A BOW

BACKGROUND OF THE INVENTION

This invention relates to an illuminated sight having a light-dispersing end portion that can extend in a line-of-sight with a target while the sight is supported by a holder on a bow above an arrow-receiving portion thereof. More particularly, the present invention relates to such a sight in which the light-dispersing end portion is releasably joined to a member having a hollowed-out portion to receive a socket and an incandescent light bulb while wires extend from the socket to a power supply circuit that includes a switch and a battery.

An experienced archer will always nock an arrow at the same point on a bowstring, draw the string back so that a particular portion of the hand contacts a particular portion of the head, elevate or lower the head of the arrow to compensate for the distance the arrow is expected to fall during flight before hitting the target, and then release the string to propel the arrow toward the target. This procedure is executed so that the feathered end of the arrow is always substantially at the same distance from the eye such that the only variable condition for hitting the target is the distance between the target and the arrow. Some archers aim a bow by intuition; while skilled archers employ bow sights. Bow sights are used for sighting or aiming the arrow at different ranges. A bow sight may be provided with a single sighting element that can be slid along a track extending substantially parallel to the string of the bow. The track for the sighting element will extend above the arrow-receiving portion of the bow such that the sighting element is elevated or lowered to a position corresponding to the range or distance over which the arrow is to be shot. The track member may have positions indicated thereon to correspond to different ranges through which the arrow is to be shot. An example of this type of sight can be found in U.S. Pat. No. 2,998,652. A hunter, upon sighting a target which may, for example, be a deer, must estimate the distance of the target, adjust the sight, nock his arrow, aim and then release the arrow. The hunter's actions must be completed quickly to avoid loss of sight of the target. However, a considerable amount of time can be required to visually locate the sighting element, particularly under a condition of low ambient light. The sight element is generally painted black and it is generally small to accurately establish a line-of-sight with the target.

Another common type of sighting element employs a plurality of sighting elements, each of which is spaced above the arrow-receiving portion of the bow by a different distance. An archer must estimate a particular range or distance between the target and the bow; select a particular sighting element corresponding to the selected range; position the bow to bring the selected sighting element into the line-of-sight with the target; and then release the arrow using the selected sighting element. The highest sighting element corresponds to a short range while the lowest sighting element corresponds to the longest range. The sighting elements are prepositioned by experimentation with the bow on which the sight is mounted. One example of this type of bow can be found in U.S. Pat. No. 2,332,080. Aiming of the bow with this type of sight may be confusing to the archer because of the plurality of sighting elements in the field-of-view. In U.S. Pat. No. 3,310,875, there is disclosed an archery bow sight having a plurality of sighting elements disposed above an arrow-receiving portion of the bow and spaced therefrom at different distances. The sighting elements are normally disposed in an out-position wherein they are out of the line-of-sight. Each of the sighting elements is movable between the out-position and a sight-position wherein they extend tranversely to the body of the bow and can be selected for aiming the bow. The sighting elements are prepositioned on a carrier member by experimentation. A sighting element is secured at a known position along the carrier member and used for sighting a target which is at a predetermined distance from the bow. However, the sight member is repositioned in the event the arrow strikes the ground ahead of the target or beyond the target. The markings on the sighting element are selected to indicate to the archer the distance between the target and the arrow before the archer releases the arrow.

Another example of this type of archery bow sight is disclosed in U.S. Pat. No. 3,579,839 in which an archery bow sight incorporates a Vernier adjustment on the bracket for modifying the range after the sighting element is positioned at an approximate range position along the bracket. A screw device is supported between flanged portions of an elongated member adapted to be secured to the body of a bow. A plurality of sighting element carriers is threadedly received on the screw device and means are provided for preventing rotation of the carrier as the screw device is rotated such that the carrier can be moved upwardly or downwardly as the screw device is rotated. This construction of parts is intended to provide a Vernier adjustment of the sighting elements mounted on the carrier by rotation of the screw means.

Another form of an archery bow sight of this type is disclosed in U.S. Pat. No. 3,822,479 in which a bow sight incorporates adjusting means for each of a plurality of sighting elements by which each element can be moved along a screw device independently of other sighting elements. A master dial is used for rotating the screw device to move all sighting elements in unison and resilient means releasably holds each sighting element is a sighting or out-position.

The present invention provides an improved sight that can be used with any one of the bow sights described hereinabove to greatly enhance the sighting process by providing a sight tip of any diverse form that is illuminated to improve the usefulness of such sights to an archer. The light emitted from the illuminated sight tip is desirably small but the intensity of the illuminated sight tip must be sufficient to very quickly attract the archer's attention to the sight tip during the aiming process as well as the launching of an arrow. However, the intensity of the light dispersed from the tip and illuminated by the tip of the sight must not produce glare due to fatiguing the cones of the macular area of the eye.

SUMMARY OF THE INVENTION

It is an object of the present invention to provide a device for aiming a bow that includes a sight which is illuminated by electromagnetic wave energy from an incandescent light bulb along a pathway that is formed in the sight while the assembly is carried on a suitable support such as a bow sight that is, in turn, affixed to a bow and coupled to a power supply that includes switch means.

More particularly, according to the present invention there is provided a device for use in aiming a bow wherein the device comprises, in combination, first and second generally cylindrical members having between them a releasable connection, the second member having a light-conductive pathway communicating with an end portion of the first member at the releasable connection, an incandescent light means supported in the first member for irradiating the light-conductive pathway of the second member, the second member having a light-dispersing end portion communicating with the light-conductive pathway, power means including a switch coupled for energizing the incandescent light means, and holder means adapted to be secured to the bow above an arrow-receiving portion thereof for supporting the first and second cylindrical members such that the light-dispersing end portion can extend in the line-of-sight with a target.

These features and advantages of the present invention as well as others will be more fully understood when the following description is read in light of the accompanying drawings, in which.

Figure 1:
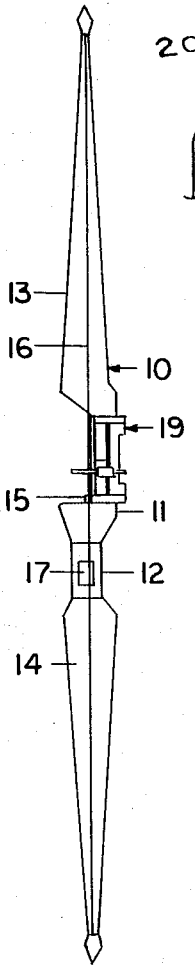
FIG. 1 is a front elevational view of a conventional bow provided with a bow sight which embodies the features of the present invention.

The conventional bow illustrated in FIG. 1 includes a central body portion 11 beneath which there is located a gripping portion 12. A pair of upper and lower arms 13 and 14, respectively, extend upwardly and downwardly from the portion 12 of the bow as seen by the archer using the bow. Above the portion 11 there is a receiving area 15 for an arrow that is engaged with a string 16. When the string is pulled away from the central body portion, the arms 13 and 14 bend to provide a force for propelling the arrow. It is within the scope of the present invention to provide a pressure-actuated switch 17 on the gripping portion 12 so that the switch is actuated by the pressure which is applied by the hand of the archer to the gripping portion when drawing the bow. As will be explained hereinafter, a control switch may be situated at other places on the sight for the bow without departing from the spirit of the present invention. A bow sight 19 is secured to the side of the central body portion 11 by means of a bracket in a manner which is, per se, known in the art.

Figure 2:
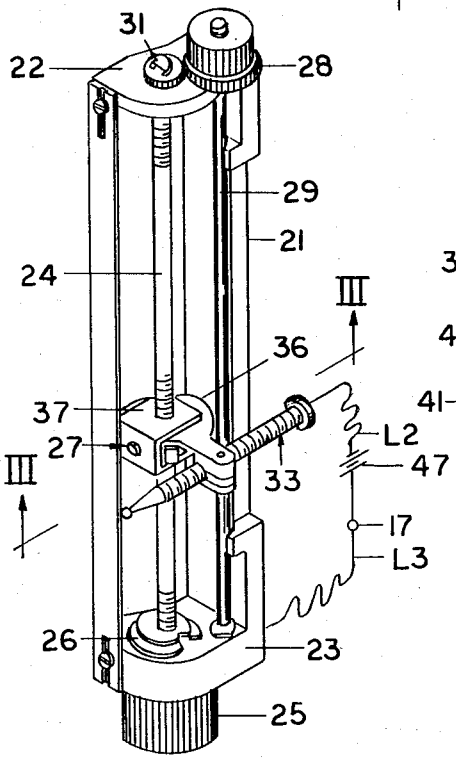
FIG. 2 is an enlarged isometric view of a bow sight assembly incorporating a lighted sight pin according to one embodiment of the present invention.

In FIG. 2, one form of a bow sight structure that is suitable for use with the lighted sight pin of the present invention is shown. It is to be understood, however, that other forms of bow sight structures may be used with the device of the present invention. The bow sight structure shown in FIG. 2 includes a frame 21 having upper and lower flanges 22 and 23, respectively. A threaded shaft 24 is rotatably supported at the opposite ends thereof by the flanges 22 and 23. End portions of shaft 24 project from the flanges 22 and 23. A drive knob 25 is secured to the portion of the shaft 24 extending from flange 23 for direct transmission of torque to the shaft. A lock ring 26 prevents movement of the shaft in an axial direction. When the knob 25 is rotated, shaft 24 also rotates to displace a sight assembly 27 threadedly engaged therewith along the shaft. The sight assembly can also be moved along the shaft by torque applied to another knob having a drive wheel 28 which is rotatably supported on the end portion of a rod 29 that projects from the flange 22. The diameter of drive wheel 28 is large as compared with the diameter of a drive pinion 31 which meshes therewith and is secured to the end portion of shaft 24 projecting from flange 22. The drive wheel 28 typically forms an auxilary drive means for rapidly moving the sight assembly along the shaft 24 while knob 25 forms fine adjustments to the sight assembly along the shaft.

Figure 3:
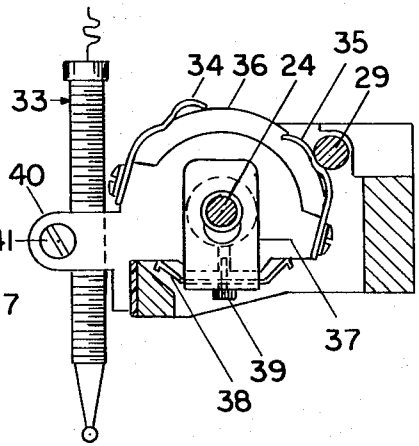
FIG. 3 is a sectional view taken along line III—III of FIG. 2.

If desired, a plurality of spaced-apart sight assemblies 27 may be positioned on shaft 24. The sight assembly 27, or if a plurality of sight assemblies is provided, can be moved between a sighting position wherein a sight pin assembly 33 is swung between a sighting position wherein a sight pin element is in the line-of-sight of the archer and an out-position wherein the sight pin is out of the line-of-sight. As shown in FIGS. 2 and 3, spring elements 34 and 35 cooperate with rod 29 to hold the sight pin assembly in the sight-in and sight-out positions. The springs 34 and 35 are secured by fasteners to a carrier body 36. A C-shaped member 37 has leg portions that extend along opposite sides of the carrier body where elongated slots in the leg portions engage with threaded shaft 24 under the force of a leaf spring 38 that urges the C-shaped member outwardly against a stop pin 39. When the C-shaped member is pressed in a direction against the force of spring 38, an enlarged portion of the opening in the leg portions thereof establishes a clearance with the threads on shaft 24 so that the sight assembly can be freely moved along the threaded shaft 24.

The sight pin assembly 33 is threadedly supported on a threaded surface of opposed spring arm portions 40 that extend from the sight body 36. A threaded fastener 41 is used to apply a clamping force to the spring arms for holding the sight pin assembly 33 at a desired position.

Figure 4:
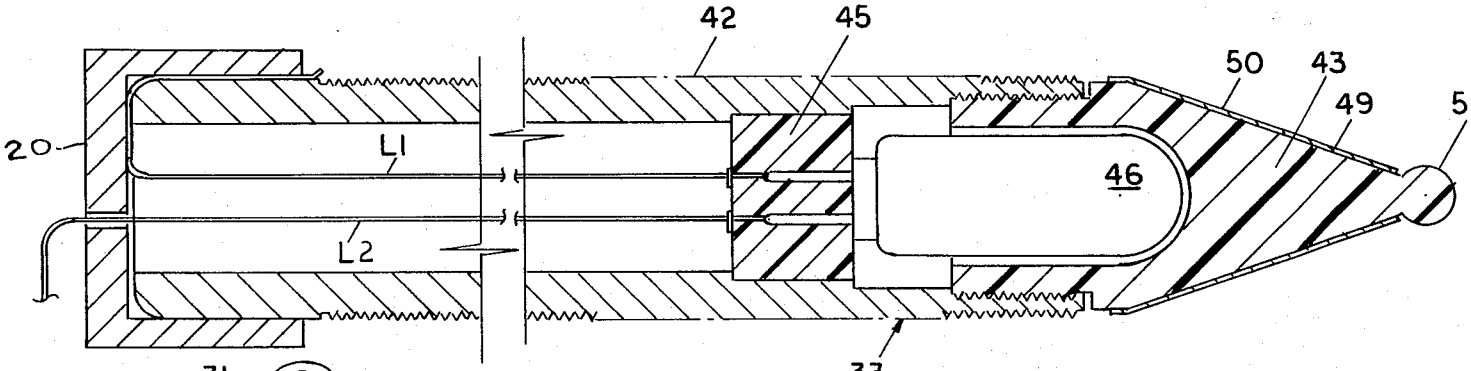
FIG. 4 is an enlarged view, partly in section, of the lighted sight pin shown in FIGS. 2 and 3.

As shown in FIG. 4, the sight pin assembly 33 includes two members 42 and 43 that are joined together by a threaded connection. The threaded connection is formed by internal threads in an end portion of member 42 and external threads on an end portion of member 43. Member 42 may preferably be comprised of metal and provided with threads along substantially the entire external surface thereof for engagement with the threads formed in the clamp members 40. Member 42 has an internal longitudinal cavity in which a socket 45 is supported. The socket is of a type constructed to receive bare lead wires extending from an incandescent light bulb 46. Other forms of incandescent light bulbs and sockets can be used without departing from the present invention. It is essential to utilize an incandescent light bulb in the sight pin assembly to insure that a sufficient quantity of light can be produced and conducted to member 43. A neon lamp, for example, cannot be used because the necessary operating voltage exceeds that which a portable power supply can provide. A light-emitting diode creates a source of light that is too large and not sufficiently intense to accurately aim a bow. To permit replacement of bulb 46, socket 45 is located so that the bulb protrudes only a slight distance from the internally-threaded end of the member 42. This also permits use of other bulbs at different voltage ratings which match the voltage of the power source. The voltage of the power source can be changed, if desired. For example, a battery supply at 1.5 volts can be replaced by a battery supply at 9 volts.

Member 42 has a hollow configuration so that leads $L_1$ and $L_2$ can extend along substantially the entire length of the member where, according to the embodiment shown in FIG. 2, the lead $L_1$ is grounded to member 42 by an end cap 20. Lead $L_2$ extends through an opening in the end cap to a power supply. As shown in FIG. 2, the power supply includes a battery 47 having a terminal to which lead $L_2$ is connected. The remaining terminal of the battery is coupled by lead $L_3$ to the frame 21 through switch 17. In this embodiment, the frame 21 is connected to form an electrically-conductive path to lead $L_1$. As previously described, lead $L_1$ is grounded to member 42 which is part of a system of elements in metal-to-metal contact; namely, carrier body 36, shaft 24 and flanges 22 and 23 of frame 21. Switch 17 controllably energizes the bulb 46 when the sight assembly is in use. However, lead $L_1$ can extend directly to one terminal of a toggle switch, for example, having the other terminal directly connected to lead $L_3$ to control the supply of current to the bulb. It is also contemplated within the scope of the present invention to incorporate the switch into the battery.

Returning, now, to members 42 and 43 of the sight pin assembly 33, the member 42 if made of plastic is coated or made of opaque plastic material to prevent the emission of light. The member 43 must be transmissive to electromagnetic light waves and prevent dispersing the light form a conical portion 49. Conical portion 49 is provided with a film 50 of light-impervious paint and extends forwardly from the threaded connection to a light-dispersing end portion which, in the embodiment shown in FIGS. 2–4, takes the form of a spheroid 51 that is supported by and is an integral part of the member 43. The intensity of light dispersed from the spheroid 51 was found sufficient because of the use of the incandescent light bulb 46 to quickly attract and maintain the archer's concentration while sighting the bow without adverse affects under varied ambient light conditions. If desired, a variable resistor may be coupled in the circuit of the power supply to control the intensity of dispersed light, but this is not believed necessary.

Figure 5:
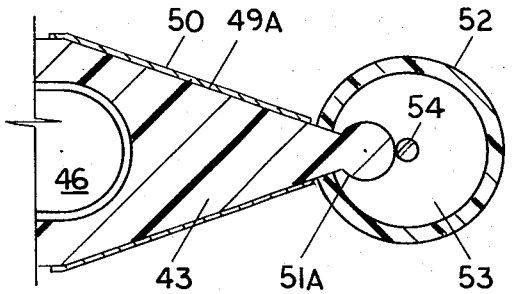
FIG. 5 is a fragmentary view of a further form of a sight tip for the sight pin of the present invention.

FIG. 5 illustrates a further form of member 43 which differs from that already described essentially by the provision of a light-dispersing ring 52 having an opening 53 wherein a bull's eye sight point is defined by a small spheroid 54. Spheroid 51A may be coated with film 50. The ring 52 is preferably comprised of the same plastic material used to form member 43. The conical portion 49A of the member 43 is truncated by the addition of the ring 52. Only a small amount of light is dispersed from the ring 52 as compared with a concentrated, intense dispersion of light from spheroid 54.

Figure 6:
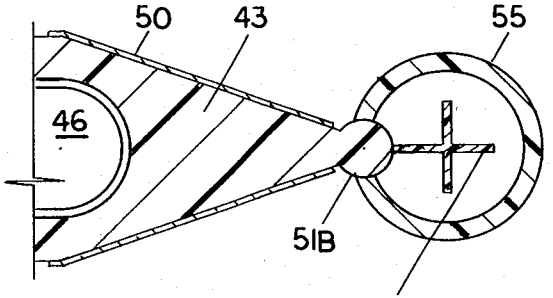
FIG. 6 is another view of the sight tip for the lighted sight pin of the present invention.

In FIG. 6, a further embodiment of member 43 is shown in which a ring 55 extends outwardly from a diameter of the spheroid 51B. The ring 55 is joined with the spheroid 51B and preferably is an integral part of and comprised of the same plastic material forming member 43. Ring 55 encircles a bull's eye sight 56 which is a light-dispersing extension of spheroid 51B which may be coated with film 50.

Figure 7:
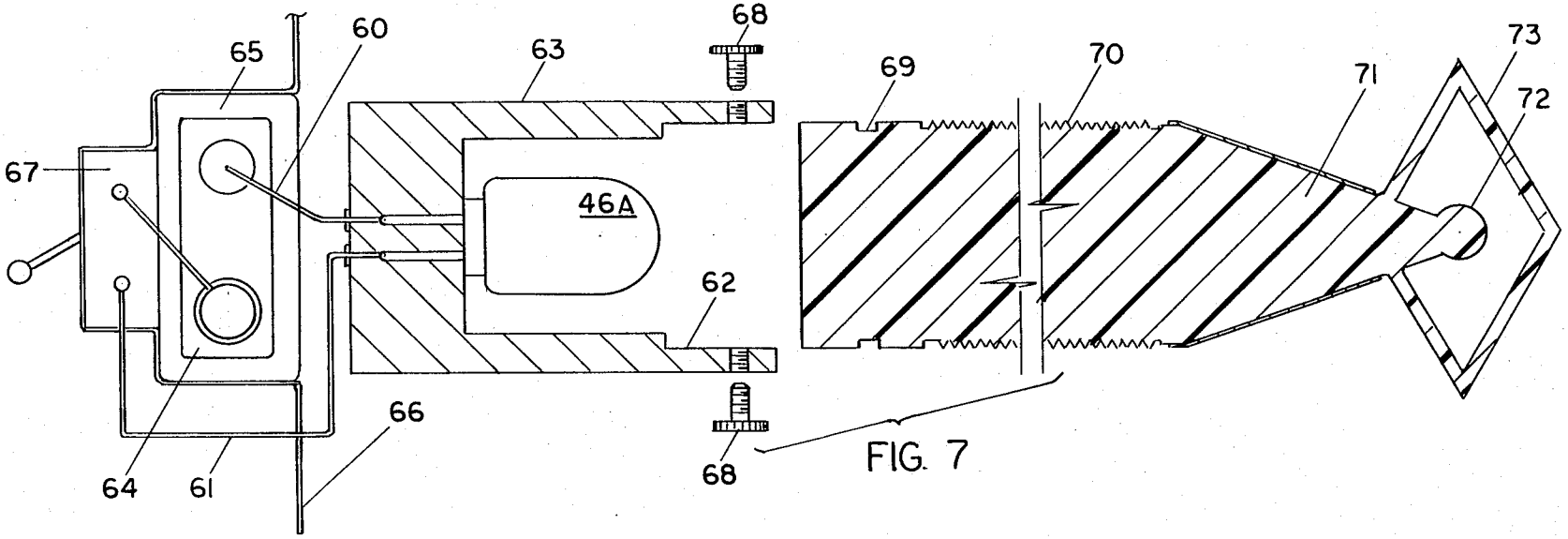
FIG. 7 is an enlarged view, partly in section, of another embodiment of the lighted sight pin of the present invention.

In the embodiment of the invention shown in FIG. 7, lead wires 60 and 61 extend from an incandescent light bulb 46A which is located in a cavity 62 extending to one end of a member 63. The lead wires have a length which is sufficient so that they can extend to a battery clip 64 forming part of a power supply that also includes a battery 65 having terminals engaged with terminals on the battery clip. An adhesive surface of a length of tape 66 is wrapped about three sides of the battery as shown in FIG. 7 so that end portions of the tape can be adhesively attached to the sight or, if desired, to the bow at any convenient location. A switch 67 is held by an additional length of adhesive tape to the battery. The switch is coupled in the electrical circuit to control the supply of battery current to the bulb 46A. If desired, the switch 67 may be replaced by the pressure-sensitive switch 17. Threaded fasteners 68 are received in tapped holes in the side walls of member 63 so that end portions of the fasteners engage in a groove 69 formed in the end portion of an elongated sight pin member 70. Threads on the external surface of member 70 extend to a conical end portion 71 that supports a spheroid 72 within an opening of a diamond-shaped sighting aid 73. An impervious film may be applied to the threads on member 70 which is supported by arm portions 40 of the sight body 36.

Figure 8:
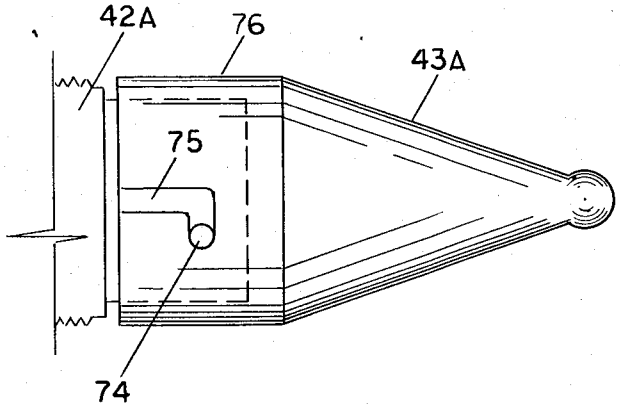
FIG. 8 is a fragmentary view of a further embodiment of a lighted sight pin according to the present invention.

In FIG. 8, a further embodiment of the sight pin assembly 33 is shown and differs from the embodiment of the sight pin assembly shown in FIGS. 2–4 by the provision of a bayonet-type releasable connection between member 42A and member 43A. The releasable connection is formed by diametrically-extending pins 74 from the end portion of member 42A. The pins 74 can slide along slots 75 extending in an L-shaped fashion in an enlarged end collar 76 on member 43A. By twisting the collar 76 on member 42A, the pins 74 move from the leg portions of the slots 75. Thereafter, the member 43A can be pulled from the end portion of member 42A whereby pins 74 slide along the shank portion of slots 75. In the locked position of members 42A and 43A, an interface of abutting flat surfaces produces good light-transmissive properties.

Figure 9:
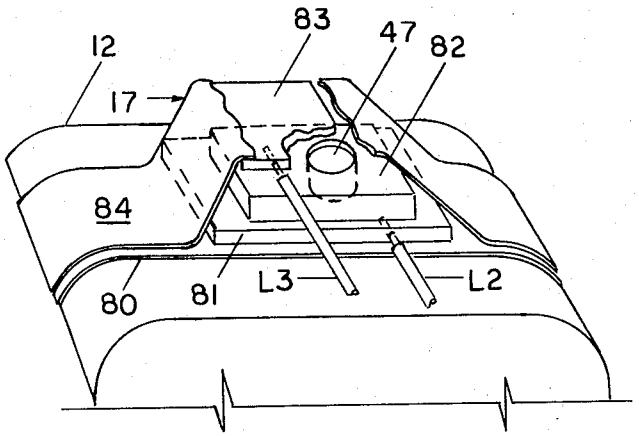
FIG. 9 is an isometric view of a pressure-actuated switch to energize the sight pin according to the present invention.

In FIG. 9, there is illustrated the details of switch 17. A layer of tape 80 is adhered to gripping portion 12. A small metal plate 81 is placed on the tape at a convenient sight, e.g., underlying the palm or finger of the archer's hand. Lead $L_2$ is connected to plate 81. A rectangular block 82 made of resilient material, e.g., foam rubber, has a central opening in which battery 47 is supported. The configuration of the battery is, per se, well known. The thickness of the block 82 is about $\frac{1}{8}''$ greater than the dimension between the battery contacts at opposite sides thereof. A metal plate 83 is placed on top of the block 82. Lead $L_3$ is connected to plate 83. An outer wrap of tape 84 is placed over plate 83 and extends along opposite sides of block 82 and plate 81. End portions of tape 84 are adhered to the tape 80 and preferably wrap about gripping portion 12. When pressure is applied to the portion of tape 84 overlying plate 83, the block 82 is compressed to the extent sufficient to make electrical contact between plates 81 and 83 and the terminals on opposite sides of battery 47. In this way, plates 81 and 83 and block 82 function in the manner of a pressure-sensitive switch.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A device for use in aiming a bow, said device comprising, in combination, first and second members having between them a releasable interlocking connection, said second member having a light-conductive pathway communicating with an end portion of said first member at said releasable interlocking connection, said first member having an internal cavity extending to the sight of said connection, a light bulb socket supported in said internal cavity in said first member for access by disengaging said releasable interlocking connection, an incandescent light bulb accessible in said first member while operatively engaged with said socket, said second member having a cavity to received a portion of said bulb such that the bulb confronts and irradiates the light-conductive pathway of said second member, said second member having a reduced size body position extending to a light-dispersing end portion communicating with said light-conductive pathway, power means including a switch coupled by an electrical conductor in said first member for energizing said incandescent light bulb, and holder means adapted to be secured to the bow above an arrow-receiving portion thereof for supporting said first and second cylindrical members such that said light-dispersing end portion can extend in a line-of-sight with a target.

2. The device according to claim 1 wherein said light-dispersing end portion comprises a spheroidally-shaped sight member supported at the apex of a conically-shaped end portion of said second member.

3. The device according to claim 1 wherein said light-dispersing end portion comprises a ring-shaped sight member supported at the apex of a conically-shaped end portion of said second member.

4. The device according to claim 1 wherein said light-dispersing end portion comprises a diamond-shaped sight member supported on a conically-shaped end portion of said second member.

5. The device according to claim 1 wherein said power means further includes a battery having electrical terminals, and connector plates at opposite sides of a resilient spacer block to support said battery so that said connector plates contact the electrical terminals of said battery when said block is compressed.

6. The device according to claim 5 further including means for attaching said power means to a bow.

7. The device according to claim 1 wherein said second generally cylindrical member includes an externally-threaded surface along a substantial length thereof and extending to the end of the second member at said releasable interlocking connection.

8. The device according to claim 1 wherein said releasable interlocking connection comprises internal threads at an end portion of one of said members, and an externally-threaded connector section at an end portion of the other of said members.

9. The device according to claim 1 wherein one of said members includes a diametrically-extending pin at an end portion thereof and the other of said members includes an end collar having a slot therein to releasably receive said extending pin.

* * * * *